US009915888B2

(12) United States Patent
Morishita et al.

(10) Patent No.: US 9,915,888 B2
(45) Date of Patent: Mar. 13, 2018

(54) IMAGE CARRYING MEMBER UNIT AND IMAGE FORMING APPARATUS PROVIDED WITH SAME

(71) Applicant: KYOCERA Document Solutions Inc., Osaka (JP)

(72) Inventors: Hiroki Morishita, Osaka (JP); Yasuyuki Fukunaga, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 15 days.

(21) Appl. No.: 15/325,348

(22) PCT Filed: Feb. 2, 2016

(86) PCT No.: PCT/JP2016/053082
§ 371 (c)(1),
(2) Date: Jan. 10, 2017

(87) PCT Pub. No.: WO2016/163138
PCT Pub. Date: Oct. 13, 2016

(65) Prior Publication Data

US 2017/0184991 A1 Jun. 29, 2017

(30) Foreign Application Priority Data

Apr. 7, 2015 (JP) ..... 2015-078275

(51) Int. Cl.
*G03G 15/02* (2006.01)

(52) U.S. Cl.
CPC ..... *G03G 15/0225* (2013.01)

(58) Field of Classification Search
CPC ..... G03G 15/0225; G03G 15/0258
See application file for complete search history.

(56) References Cited

U.S. PATENT DOCUMENTS

2015/0098725 A1* 4/2015 Kobayashi ..... G03G 15/0225 399/100

FOREIGN PATENT DOCUMENTS

JP 2008-89636 A 4/2008
JP 2009145633 A * 7/2009

OTHER PUBLICATIONS

Fujii (JP 2009-145633 A), Jul. 2009, JPO Computer Translation.*

* cited by examiner

*Primary Examiner* — Erika J Villaluna
(74) *Attorney, Agent, or Firm* — Stein IP, LLC

(57) ABSTRACT

Image carrying member units are each provided with an image carrying member, a charging device, and a pair of support frames. The charging device has: a charging roller that charges the image carrying member by rotation driven by the image carrying member; a cleaning member for cleaning the charging roller; a pair of bearing members for rotatably supporting both end parts of the cleaning member and the charging roller; and biasing members for biasing the bearing members in a direction in which the same moves closer to the image carrying member. An image carrying member bearing part and a first cleaning member bearing part for rotatably supporting one end part of the rotating shaft for the cleaning member where an input side gear is provided, are formed integrally on a first support frame for supporting one end part of the image carrying member where an output side gear is provided.

5 Claims, 9 Drawing Sheets

IMAGE CARRYING MEMBER UNIT AND IMAGE FORMING APPARATUS PROVIDED WITH SAME

CROSS-REFERENCE TO RELATED APPLICATIONS

This application is a national stage of International Application No. PCT/JP2016/053082, filed Feb. 2, 2016, which claims the benefit of priority to Japanese Application No. 2015-078275, filed Apr. 7, 2015, in the Japanese Patent Office, the disclosures of which are incorporated herein in their entireties by reference.

TECHNICAL FIELD

The present invention relates to a charging device incorporated in an image forming apparatus (device) exploiting electrophotography, such as a copier, a printer, a facsimile machine, or a multifunction peripheral thereof, and to an image forming apparatus provided with the charging device. More particularly, the present invention relates to an image carrying member (image carrier) unit in which an image carrying member and a charging device having a mechanism which cleans a charging roller are integrated into a unit, and to an image forming apparatus provided with such an image carrying member unit.

BACKGROUND ART

In conventional image forming apparatuses exploiting electrophotography, a charging device is incorporated for electrostatically charging the surface of a photosensitive member which is an image carrying member. There are known charging devices of a corona charging type in which a photosensitive member and a corona wire are arranged with no contact with each other to electrostatically charge the surface of the photosensitive member by corona discharge, and charging devices of a contact charging type in which contact is made with the surface of a photosensitive member by use of a charging member such as a charging roller. However, in recent years, to reduce the amount of discharged ozone, which is harmful to the human body, the contact charging-type charging devices, which discharge less ozone, have been increasingly used.

When a charging roller is brought into contact with the surface of a photosensitive member in such a contact charging-type charging device, foreign matter such as a toner component or paper dust of sheets may attach to the surface of the photosensitive member, and the foreign matter may move to the surface of the charging roller. The foreign matter attached to the surface of the charging roller causes failure to electrostatically charge the surface of the photosensitive member, greatly affecting the image quality of images printed. To prevent the foreign matter from attaching to the charging roller as described above, conventionally, by bringing a cleaning member such as a cleaning brush or a cleaning roller into contact with the surface of the charging roller, the foreign matter attached to the charging roller is removed.

For example, Patent Document 1 discloses an image forming apparatus in which a cleaning roller in pressed contact with the circumferential surface of a charging roller is driven to rotate while keeping a linear velocity difference relative to the charging roller, and the cleaning roller reciprocates in the axial direction of the charging roller so that soil on the charging roller is removed.

LIST OF CITATIONS

Patent Literature

Patent Document 1: JP-A-2008-89636

SUMMARY OF THE INVENTION

Technical Problem

In a configuration as described above which has a charging roller and a cleaning member for cleaning the charging roller, a nip (gap) between the cleaning member and the charging roller is set to be a predetermined interval (about 0.5 mm). A narrower nip leads to increased resistance of the cleaning member against the charging roller which rotates by following a photosensitive drum as it rotates; this causes the charging roller to slip on the surface of the photosensitive drum, causing failure to electrostatically charge the surface of the photosensitive drum. On the other hand, a wider nip leads to less stable contact between the cleaning member and the charging roller; this degrades the cleanability of the charging roller.

As a solution, to stabilize the nip, bearings of the charging roller and the cleaning brush are formed as integrally formed bearing members, and the bearing members are pressed by a biasing member such as a spring so as to bring the charging roller into close contact with the photosensitive drum. The charging roller rotates by following the photosensitive drum as it rotates, and the cleaning brush rotates, while keeping a predetermined linear velocity difference (about 80%) relative to the charging roller, as the driving force of a drum-side gear is transmitted via an idle gear to a brush-side gear.

However, because the cleaning brush is not positioned relative to the photosensitive drum, as the outer diameter of the charging roller varies due to a factor from the use environment, the relative position of the rotary shaft of the cleaning brush with respect to the photosensitive drum varies; this makes it difficult to stabilize the pitch dimension between the brush-side gear and the idle gear. Thus, when the outer diameter of the charging roller is small, the mesh of the brush-side gear with the idle gear is more likely to involve bottom contact in which the cog tops and cog bases (troughs) of the gears make contact with each other. As a result, the rotary shaft of the cleaning brush floats off by the reaction force which the brush-side gear receives from the idle gear, and this causes the charging roller of which the bearing is formed integrally with the bearing of the cleaning brush to bounce off the photosensitive drum (banding). This inconveniently results in uneven charge distribution on the surface of the photosensitive drum and image defects such as horizontal stripes in an output image.

Devised against the background discussed above, an object of the present invention is to provide an image carrying member unit that can effectively prevent banding on a charging roller ascribable to the mesh of gears in a driving mechanism and that can satisfactorily maintain contact between the charging roller and the cleaning member and between the charging roller and the image carrying member, and to provide an image forming apparatus provided with such an image carrying member unit.

Means for Solving the Problem

To achieve the above object, according to a first aspect of the present invention, an image carrying member unit includes an image carrying member, a charging device, and a pair of supporting frames. The image carrying member is rotatable, and has an electrostatic latent image formed on it. The charging device includes a charging roller which electrostatically charges the image carrying member while rotating in contact with the circumferential surface of the image carrying member by following the image carrying member as it rotates, a cleaning member which cleans the charging roller while rotating in contact with the circumferential surface of the charging roller, a pair of bearing members which rotatably supports opposite end parts of the cleaning member and the charging roller with a predetermined interval between the cleaning member and the charging roller, and a biasing member which biases the bearing member in a direction approaching the image carrying member. The pair of supporting frames has an image carrying member bearing formed on it. The image carrying member bearing rotatably supports one end part of the image carrying member. In the one end part of the image carrying member, an output-side gear is provided, and in one end part of a rotary shaft of the cleaning member, an input-side gear coupled to the output-side gear is provided. With a first supporting frame which supports the one end part of the image carrying member where the output-side gear is provided, the image carrying member bearing and a first cleaning member bearing which rotatably supports the one end part of the rotary shaft of the cleaning member where the input-side gear is provided are integrally formed.

Advantageous Effects of the Invention

According to the first aspect of the present invention, the image carrying member bearing, which supports one end part of the image carrying member where the output-side gear is provided, and the first cleaning member bearing, which supports one end part of the cleaning member where the input-side gear is provided, are formed integrally with the first supporting frame; this stabilizes the gear pitches of the output-side gear and the input-side gear. As a result, it is possible to effectively suppress occurrence of banding on a charging roller ascribable to the mesh of gears in a driving mechanism and occurrence of horizontal stripes in an output image resulting from banding on the charging roller.

DESCRIPTION OF EMBODIMENTS

Figure 1:
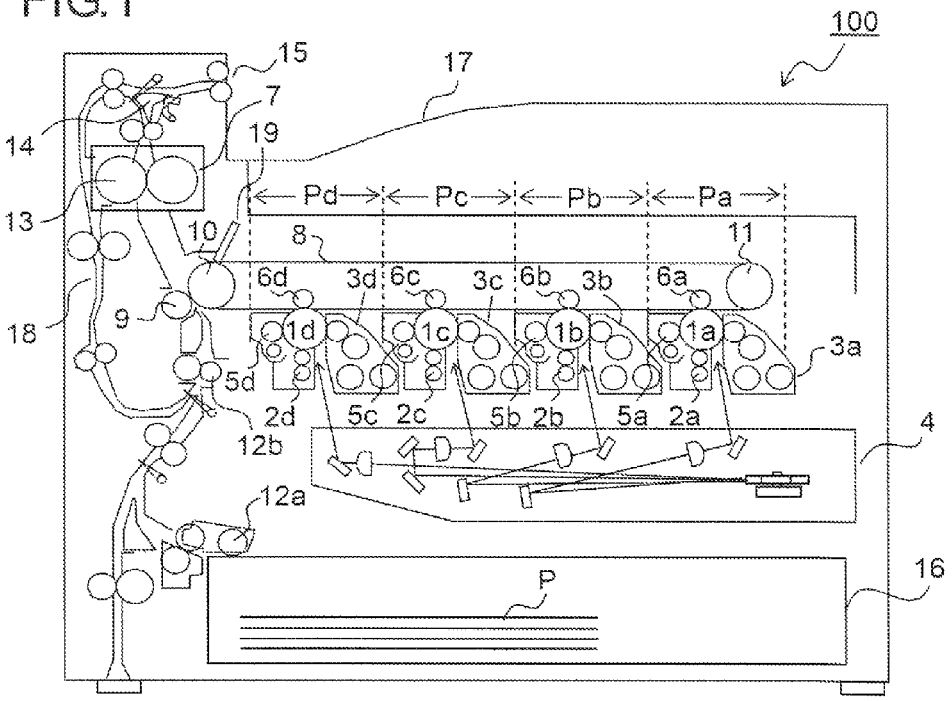
FIG. 1 is a diagram showing an outline of a construction of an image forming apparatus 100 incorporating drum units 40*a* to 40*b* according to the present invention.

Hereinafter, an embodiment of the present invention will be described with reference to the accompanying drawings. FIG. 1 is a sectional view showing an outline of the construction of an image forming apparatus 100 according to one embodiment of the present invention. In this embodiment, the image forming apparatus 100 is a quadruple-tandem-type color printer that performs image formation by use of four photosensitive drums 1*a*, 1*b*, 1*c*, and 1*d*, corresponding to four different colors (magenta, cyan, yellow, and black) respectively, which are arranged side by side.

Inside the apparatus main body of the image forming apparatus 100, four image forming sections Pa, Pb, Pc, and Pd are arranged in this order from the right side in FIG. 1. These image forming sections Pa, Pb, Pc, and Pd are provided to correspond to images of four different colors (magenta, cyan, yellow, and black) respectively. The image forming sections Pa to Pd sequentially form magenta, cyan, yellow, and black images respectively, each through the processes of electrostatic charging, exposure to light, image development, and image transfer.

In these image forming sections Pa to Pd are respectively arranged the photosensitive drums 1*a* to 1*d* that carry visible images (toner images) of the different colors. An intermediate transfer belt 8 that rotates in the clockwise direction in FIG. 1 is arranged next to the image forming sections Pa to Pd. Toner images formed on these photosensitive drums 1*a* to 1*d* are sequentially transferred to the intermediate transfer belt 8 that moves while being in contact with the photosensitive drums 1*a* to 1*d*. Then, the toner images are transferred all at once to a sheet P by a secondary transfer roller 9, fixed to the sheet P by a fixing device 7, and discharged out of the image forming apparatus 100. An image forming process is performed with respect to each of the photosensitive drums 1*a* to 1*d* while these are rotated in the counter-clockwise direction in FIG. 1.

Sheets P to which toner images are to be transferred are stored in a sheet cassette 16 arranged in a lower part of the image forming apparatus 100. A sheet P is transported via a sheet feeding roller 12*a* and a registration roller pair 12*b* to a secondary transfer roller 9. As the intermediate transfer belt 8, a dielectric resin sheet is used, which typically is, for example, a seamless belt having no seam. The intermediate transfer belt 8 and the secondary transfer roller 9 are driven to rotate at the same linear velocity as the photosensitive drums 1*a* to 1*d* by a belt driving motor (unillustrated). On the downstream side of the secondary transfer roller 9, a blade-shaped belt cleaner 19 is arranged for removing toner and the like remaining on the surface of the intermediate transfer belt 8.

Now, the image forming sections Pa to Pd will be described. Around and under the photosensitive drums 1*a* to 1*d*, which are rotatably arranged, there are arranged charging devices 2*a*, 2*b*, 2*c*, and 2*d* for electrostatically charging the photosensitive drums 1*a* to 1*d*, an exposure unit 4 for exposing the photosensitive drums 1*a* to 1*d* to light based on image data, developing devices 3*a*, 3*b*, 3*c*, and 3*d* for developing, by use of toner, electrostatic latent images formed on the photosensitive drums 1*a* to 1*d*, and cleaning devices 5*a*, 5*b*, 5*c*, and 5*d* for collecting and removing developer (toner) left unused on the photosensitive drums 1*a* to 1*d* after toner images has been transferred.

When image data is fed in from a host device such as a personal computer, the surfaces of the photosensitive drums 1*a* to 1*d* are first electrostatically charged uniformly by the charging devices 2*a* to 2*d*. Then, the surfaces of the photosensitive drums are irradiated with light based on the image data by the exposure unit 4, and thereby electrostatic latent images based on the image data are formed on the photosensitive drums 1*a* to 1*d* respectively. The developing devices 3*a* to 3*d* have developing rollers (developer carrying members) arranged opposite the photosensitive drums 1*a* to 1*d*. The developing devices 3*a* to 3*d* are charged with predetermined amounts of two-component developer containing toner of different colors, namely magenta, cyan, yellow, and black respectively.

When the proportion of toner contained in the two-component developer stored in the developing devices 3*a* to 3*d* falls below a predetermined value through formation of toner images, which will be described later, developer is supplied from toner containers (unillustrated) to the developing devices 3*a* to 3*d*. The toner contained in the developer is fed from the developing devices 3*a* to 3*d* onto the photosensitive drums 1*a* to 1*d*, and electrostatically attaches to the electrostatic latent images formed by exposure to light from the exposure unit 4. In this way, toner images based on the electrostatic latent images are formed on the photosensitive drums 1*a* to 1*d*.

Then, by the primary transfer rollers 6*a* to 6*d*, a predetermined transfer voltage is applied between the primary transfer rollers 6*a* to 6*d* and the photosensitive drums 1*a* to 1*d*, and thereby, magenta, cyan, yellow, and black toner images on the photosensitive drums 1*a* to 1*d* are primarily transferred to the intermediate transfer belt 8. These images of four colors are formed in a predetermined positional relationship prescribed to form a predetermined full-color image. The primary transfer rollers 6*a* to 6*d* are driven to rotate at the same linear velocity as the photosensitive drums 1*a* to 1*d* and the intermediate transfer belt 8 by a primary transfer roller driving motor (unillustrated). Thereafter, in preparation for subsequent formation of new electrostatic latent images, toner left unused on the surfaces of the photosensitive drums 1*a* to 1*d* is removed by the cleaning devices 5*a* to 5*d*.

The intermediate transfer belt 8 is wound around a following roller 10 and a driving roller 11. As the driving roller 11 rotates by being driven by the above-mentioned belt driving motor, the intermediate transfer belt 8 rotates in the counter-clockwise direction; meanwhile, a sheet P is transported from the registration roller pair 12*b*, with predetermined timing, to a nip (secondary transfer nip) between the secondary transfer roller 9, which is arranged next to the intermediate transfer belt 8, and the intermediate transfer belt 8. Then, at the nip, the full-color image is secondarily transferred to the sheet P. The sheet P having the toner images transferred to it is transported to the fixing device 7.

The sheet P transported to the fixing device 7 is heated and pressed while passing through a nip (fixing nip) between a fixing roller pair 13, and thereby, the toner images are fixed to the surface of the sheet P to form the predetermined full-color image. The sheet P having the full-color image formed on it is distributed between different transport directions by a branching portion 14 which branches into a plurality of directions. When an image is formed only on one side of the sheet P, the sheet P is discharged, as it is, onto a discharge tray 17 by a discharge roller pair 15.

On the other hand, when images are formed on both sides of the sheet P, a part of the sheet P having passed through the fixing device 7 is momentarily stuck out of the apparatus via the discharge roller pair 15. Thereafter, the discharge roller pair 15 is rotated in the reverse direction so that the sheet P is distributed into a reversed transport passage 18 by the branching portion 14; thus the sheet P is, with the image side reversed, transported once again to the secondary transfer roller 9. Then, the next toner images formed on the intermediate transfer belt 8 are transferred by the secondary transfer roller 9 to the side of the sheet P on which no image has yet been formed. The sheet P having the toner images transferred to it is transferred to the fixing device 7, where the toner images are fixed, and is then discharged onto the discharge tray 17 by the discharge roller pair 15.

Figure 2:
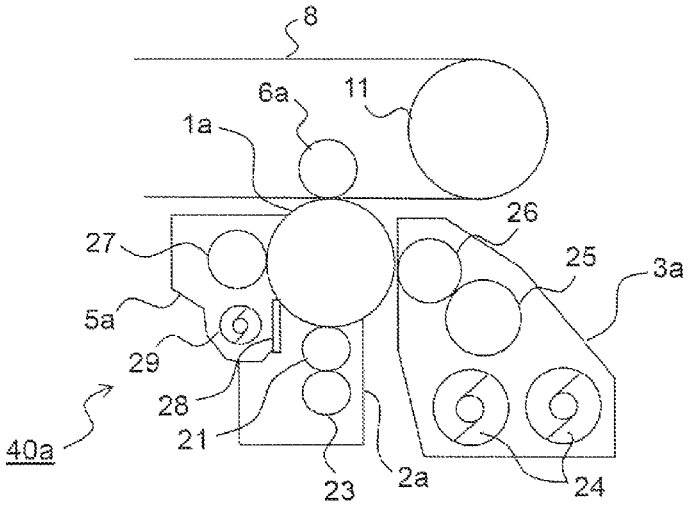
FIG. 2 is a partial sectional view around the image forming section Pa in FIG. 1.

Now, the above-described image forming section Pa will be described in detail. The image forming sections Pb to Pd have basically the same structure as the image forming section Pa, and thus no overlapping description will be repeated. FIG. 2 is an enlarged partial sectional view around the image forming section Pa in FIG. 1. Around the photosensitive drum 1*a* are arranged, along the drum rotation direction (the counter-clockwise direction in FIG. 2), the charging device 2*a*, the developing device 3*a*, the primary transfer roller 6*a*, and the cleaning device 5*a*, of which all have been already mentioned. Of these components, the primary transfer roller 6*a* is arranged opposite the photosensitive drum 1*a* across the intermediate transfer belt 8.

The photosensitive drum 1*a*, the charging device 2*a*, and the cleaning device 5*a* are integrated into a unit. In the image forming sections Pa to Pd, units composed of the photosensitive drums 1*a* to 1*d*, the charging devices 2*a* to 2*d*, and the cleaning devices 5*a* to 5*d* are hereinafter referred to as drum units 40*a* to 40*d* respectively.

The charging device 2*a* includes a charging roller 21 for applying a charging bias to the surface of the photosensitive drum 1*a* while in contact with it, and a cleaning brush 23 for cleaning the charging roller 21. The developing device 3*a* includes two stirring/transporting members 24 composed of a stirring/transporting screw and a feeding/transporting screw, a magnetic roller 25, and a developing roller 26. The developing device 3*a* makes the toner carried on the surface of the developing roller 26 fly to the surface of the photosensitive drum 1*a* to develop an electrostatic latent image into a toner image.

The cleaning device 5*a* includes a rubbing roller (abrasive member) 27, a cleaning blade 28, and a collection spiral 29. The rubbing roller 27 is in pressed contact with the photosensitive drum 1*a* under a predetermined pressure, and is driven to rotate by a drum cleaning motor (unillustrated) in the same direction as the photosensitive drum 1*a* at the plane of the contact with it. The linear velocity of the rubbing roller 27 is controlled to be higher (here 1.2 times higher) than the linear velocity of the photosensitive drum 1*a*. One example of the rubbing roller 27 adopts a structure in which a foam-material layer as a roller member made of EPDM rubber with an Asker C hardness of 55° is formed around a metal shaft. The material of the roller member is not limited to EPDM rubber; instead, any other type of rubber or a foamed rubber material may be used, for example, one with an Asker C hardness within the range of 10° to 90° is suitably used.

On the surface of the photosensitive drum 1*a*, on the downstream side of the plane of contact with the rubbing roller 27 in the rotation direction, the cleaning blade 28 is fixed in contact with the photosensitive drum 1*a*. As the cleaning blade 28, for example, a blade made of polyurethane rubber with a JIS hardness of 78° is used. The cleaning blade 28 is fitted at a position where it is in contact with the photosensitive drum 1*a* at a predetermined angle relative to the direction tangential to the photosensitive drum 1*a*. The material, hardness, and dimensions of the cleaning blade 28, the depth and pressing force with which the cleaning blade 28 is pressed onto the photosensitive drum 1*a*, etc. can be set as necessary according to the specifications of the photosensitive drum 1*a*.

The unused toner removed from the surface of the photosensitive drum 1*a* by the rubbing roller 27 and the cleaning blade 28 is, as the collection screw 29 rotates, discharged out of the cleaning device 5*a* (see FIG. 2). The toner used in the present invention is, for example, toner in which an abrasive selected from silica, titanium oxide, strontium titanate, alumina, etc. is buried in the surfaces of toner particles and held at the surfaces so as to partly protrude therefrom, or toner in which an abrasive is electrostatically attached to the toner surfaces.

Rotating the rubbing roller 27 at a different speed from the photosensitive drum 1*a* in this way permits the surface of the photosensitive drum 1*a* to be polished by the unused toner containing an abrasive. Then, by the rubbing roller 27 and the cleaning blade 28, water, discharge products, and the like remaining on the drum surface are removed together with the unused toner.

The layout inside the main body of the image forming apparatus 100 can be altered as necessary as long as it is possible to properly set the rotation directions of the photosensitive drums 1*a* to 1*d* and the intermediate transfer belt 8 and the transport passages for sheets P. Needless to say, it is possible, for example, to reverse, as compared with this embodiment, the rotation directions of the photosensitive drums 1*a* to 1*d* and the inter mediate transfer belt 8, and to reverse, as compared with this embodiment, the positional relationship of the drum units 40*a* to 40*d* and the developing devices 3*a* to 3*d*, with the transport passages for sheets P set accordingly.

Figure 3:
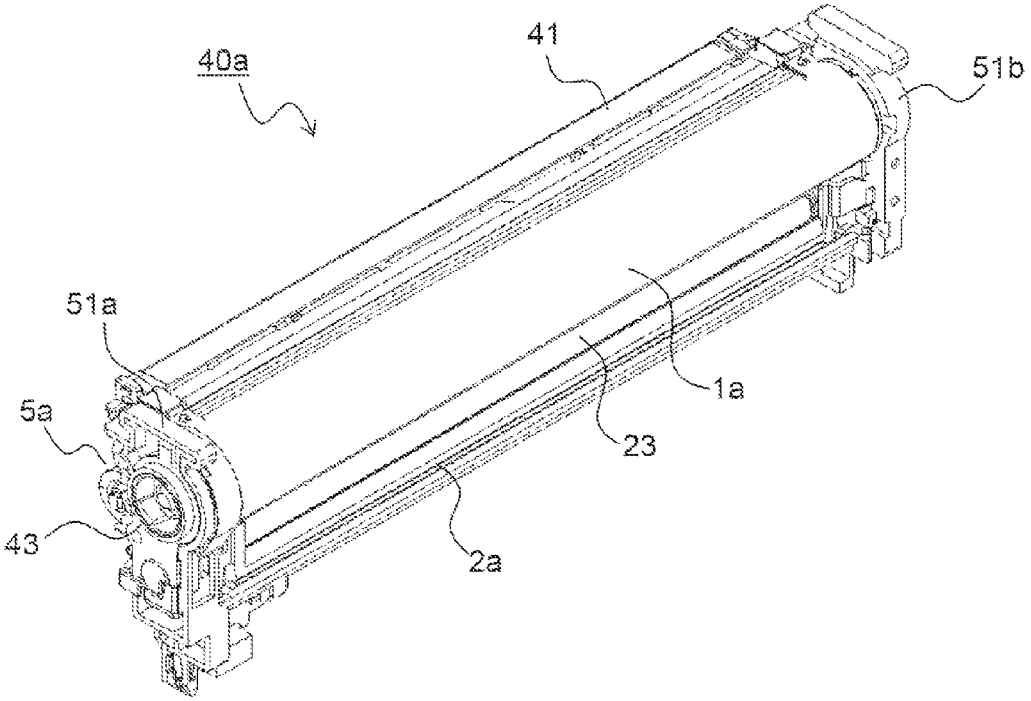
FIG. 3 is an exterior perspective view of a drum unit 40*a* according to one embodiment of the present invention as seen from the first supporting frame 51*a* side.
Figure 4:
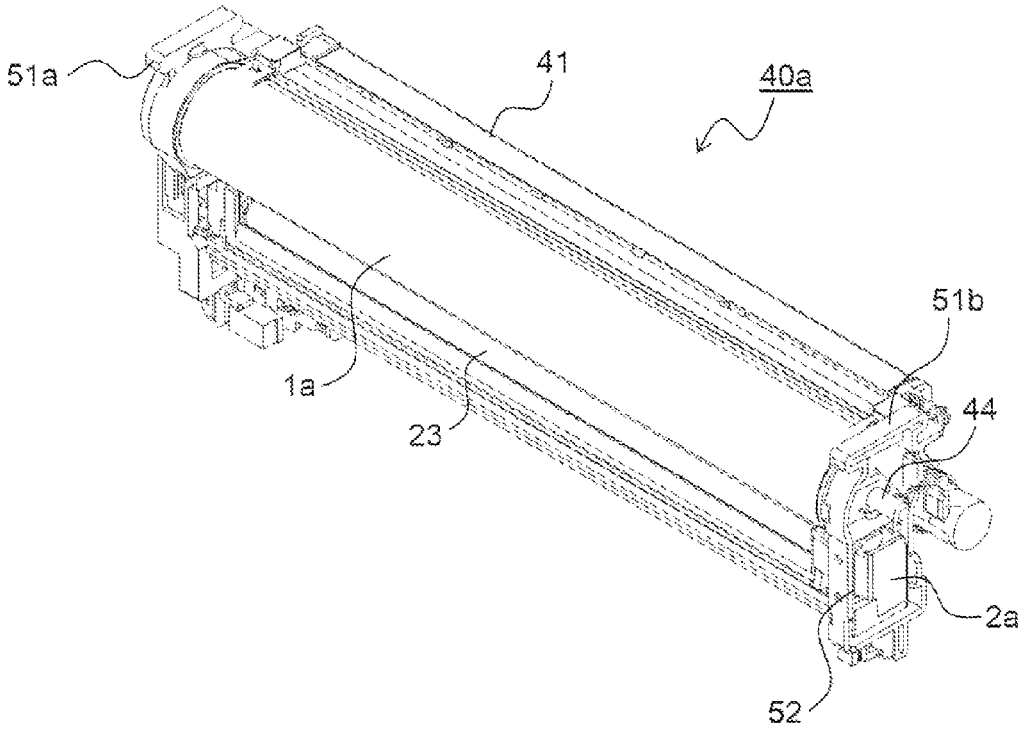
FIG. 4 is an exterior perspective view of the drum unit 40*a* according to the embodiment as seen from the second supporting frame 51*b* side.
Figure 5:
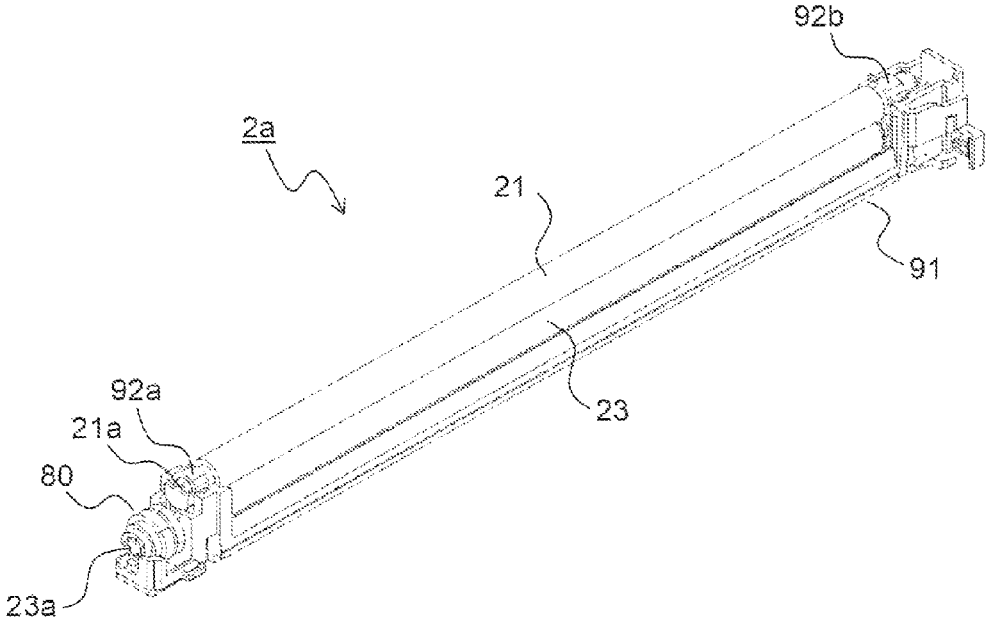
FIG. 5 is an exterior perspective view of a charging device 2*a* included in the drum unit 40*a* according to the embodiment.
Figure 6:
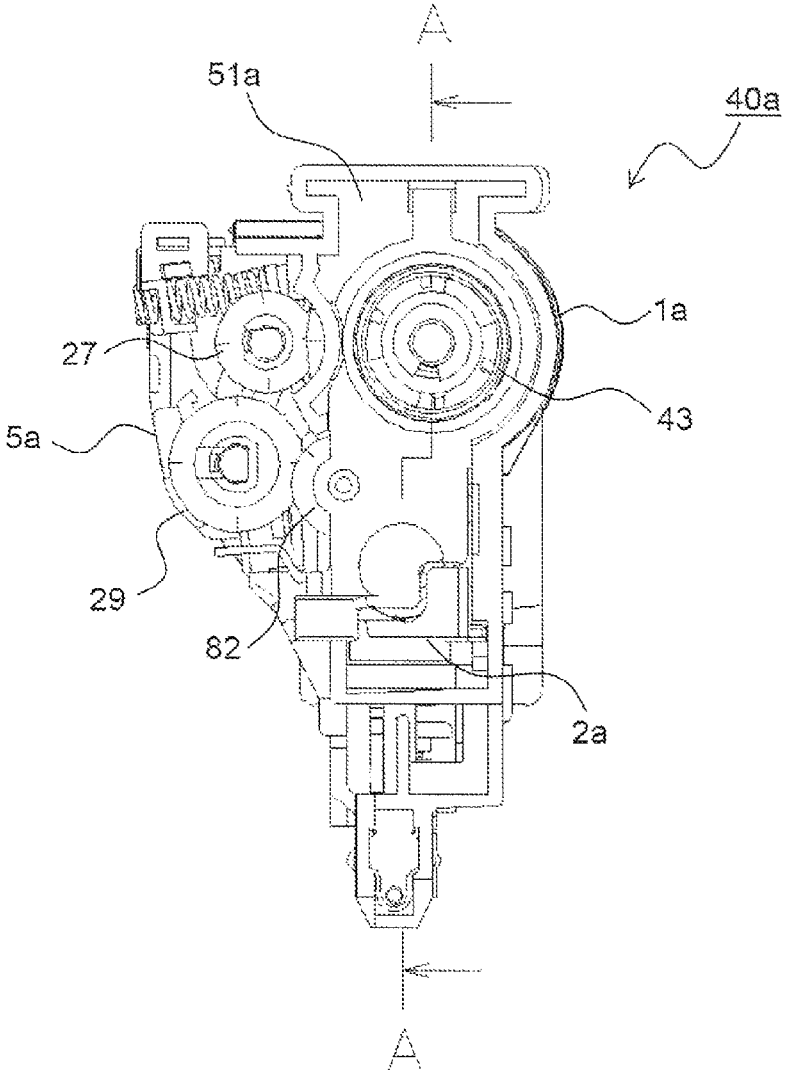
FIG. 6 is a side sectional view of the drum unit 40*a* according to the embodiment.
Figure 7:
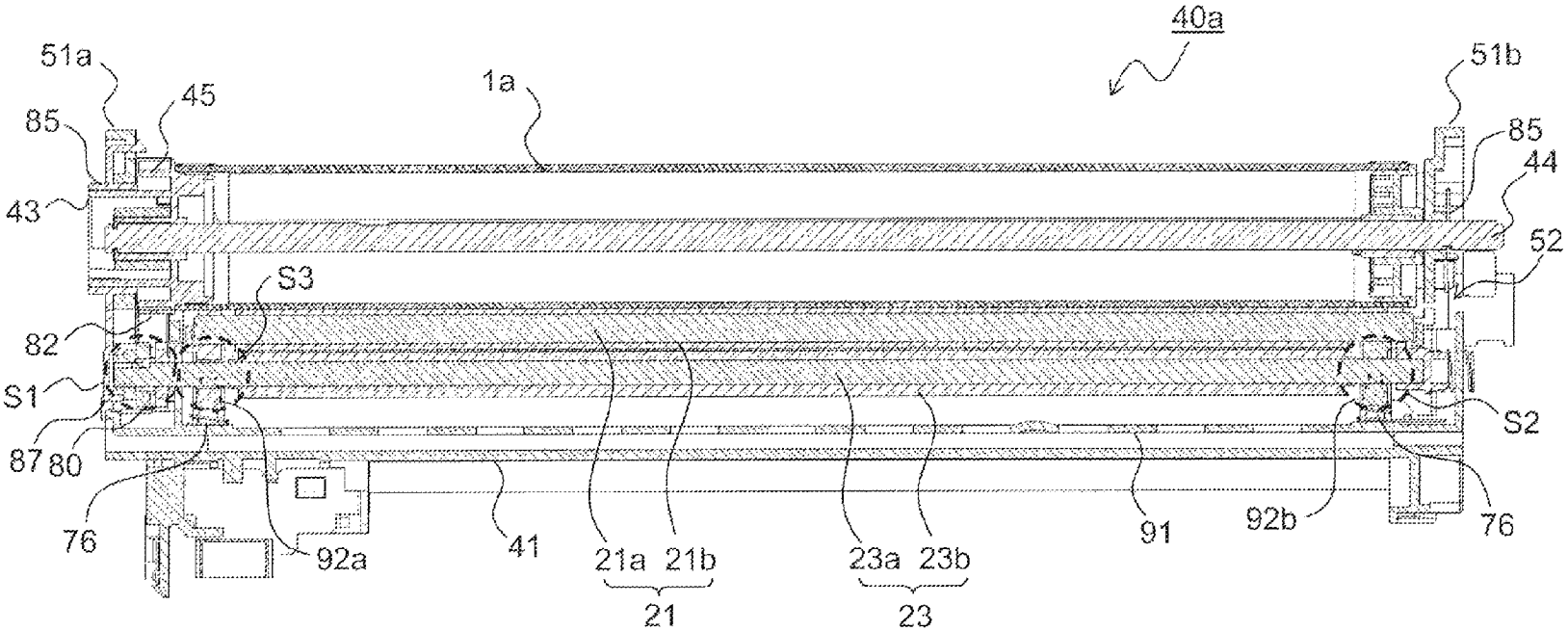
FIG. 7 is a longitudinal sectional view of the drum unit 40*a* according to the embodiment as cut along the longitudinal direction.

Now, the drum units 40*a* to 40*d* used in the above-described image forming apparatus 100 will be described with reference to FIGS. 3 to 7. FIGS. 3 and 4 are perspective views of the drum unit 40*a* as seen from the supporting frame 51*a* side and the supporting frame 51*b* side respectively. FIG. 5 is a perspective view of the charging device 2*a* included in the drum unit 40*a*. FIG. 6 is a side view of the drum unit 40*a* as seen from the supporting frame 51*a* side. FIG. 7 is a sectional view of the drum unit 40*a* as cut along the longitudinal direction (sectional view across line A-A as seen from the direction of arrows in FIG. 6). Below, a description will be given only of the drum unit 40*a* arranged in the image forming section Pa; the drum units 40*b* to 40*d* arranged in the image forming sections Pb to Pd are structured similarly.

As shown in FIGS. 3 and 4, the drum unit 40*a* includes the photosensitive drum 1*a*, the charging device 2*a*, the cleaning device 5*a*, and a unit case 41. To opposite end parts of the unit case 41 in the longitudinal direction, there is fitted a pair of supporting frames 51*a* and 51*b* for rotatably supporting opposite ends of the photosensitive drum 1*a* in the axial direction. As shown in FIG. 3, the first supporting frame 51*a* rotatably supports a drum flange 43 formed at one end of the photosensitive drum 1*a*.

As shown in FIG. 4, the second supporting frame 51*b* rotatably supports a drum rotary shaft 44 of the photosensitive drum 1*a*. In the second supporting frame 51*b*, an opening 52 is formed for mounting and dismounting the charging device 2*a*.

As shown in FIG. 5, the charging device 2*a* includes the charging roller 21, the cleaning brush 23, and a case member 91 for housing the charging roller 21 and the cleaning brush 23. The case member 91 is formed of electrically non-conductive resin so as to extend in the axial direction of the charging roller 21. The charging roller 21 comprises an electrically conductive rubber roller having an elastic layer 21*b* (see FIG. 7) of rubber or the like formed around the circumferential surface of a metal rotary shaft 21*a*. The charging roller 21 is in pressed contact with the photosensitive drum 1*a* under a predetermined nip pressure, and rotates by following the photosensitive drum 1*a* as it rotates.

The cleaning brush 23 has a brush portion 23*b* (see FIG. 7) which is formed of resin such as electrically conductive nylon around the circumferential surface of the rotary shaft 23*a* to protrude therefrom. The cleaning brush 23 removes toner, paper dust, and the like attached to the charging roller 21 by rotating with the brush portion 23*b* in contact with the circumferential surface of the charging roller 21. To one end of the rotary shaft 23*a* of the cleaning brush 23, a brush-side gear 80 is fixed. In place of the cleaning brush 23, a cleaning roller comprising a sponge-like roller made of rubber or resin may be used.

In opposite end parts of the charging roller 21 and the cleaning brush 23 in the axial direction, a pair of bearing members 92*a* and 92*b* is arranged. The first and second bearing members 92*a* and 92*b* rotatably support the rotary shaft 21*a* of the charging roller 21 and the rotary shaft 23*a* of the cleaning brush 23. The bearing members 92*a* and 92*b* are formed of electrically conductive resin.

As shown in FIG. 7, between the case member 91 and the first and second bearing members 92*a* and 92*b*, a pair of coil springs 76 is arranged. The coil springs 76 are in contact with lower parts of the first and second bearing members 92*a* and 92*b*, and are in contact also with the inner bottom wall of the case member 91. The coil spring 76 biases the charging roller 21 via the bearing members 92*a* and 92*b* toward the photosensitive drum 1*a* (the upward direction in FIG. 7). With the biasing force of the coil spring 76, the charging roller 21 is pressed uniformly in contact with the surface of the photosensitive drum 1*a*, and rotates by following the photosensitive drum 1*a* as it rotates.

Figure 8:
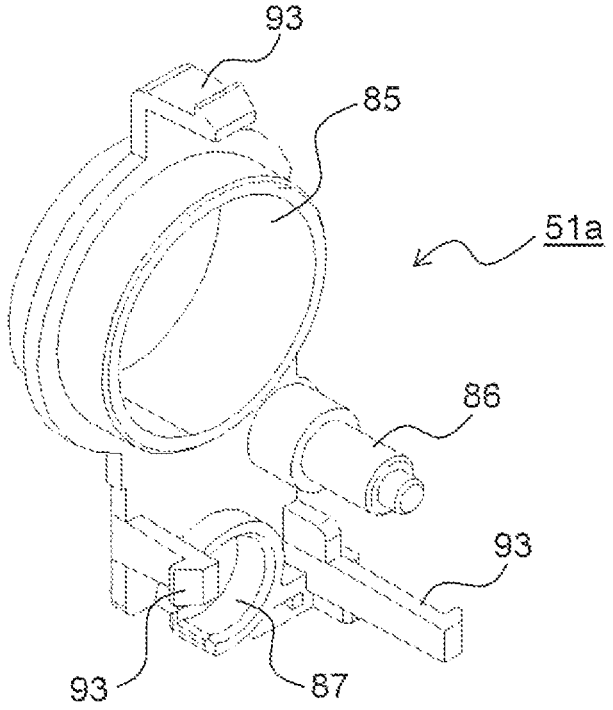
FIG. 8 is a perspective view of a first supporting frame 51*a*, as seen from the inside, which is used in the drum unit 40*a* according to the embodiment.
Figure 9:
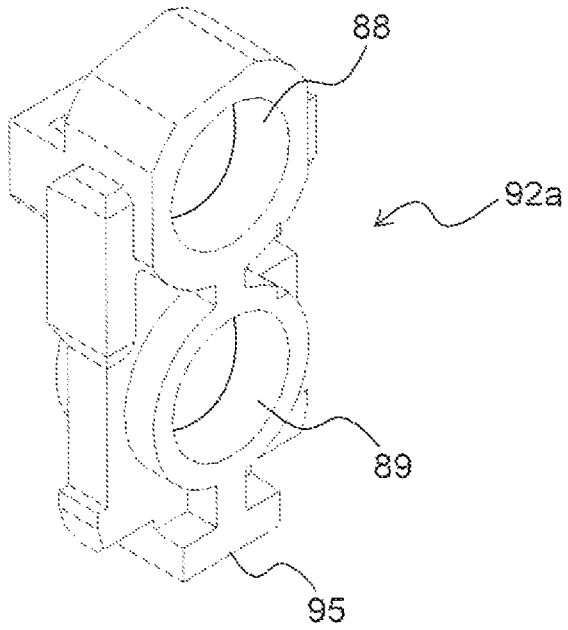
FIG. 9 is a perspective view of a first bearing member 92*a*, as seen from the inside, which is arranged in a charging device 2*a;*
Figure 10:
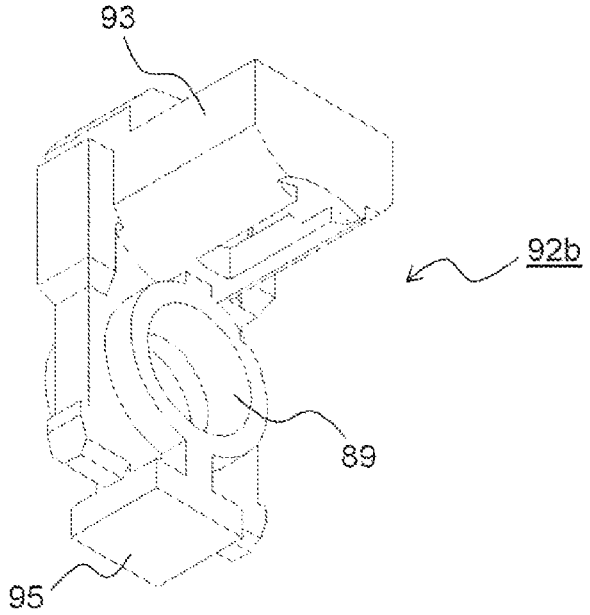
FIG. 10 is a perspective view of a second bearing member 92*b* arranged in the charging device 2*a* as seen from the outside.

FIG. 8 is a perspective view of the first supporting frame 51*a* as seen from the inside (the photosensitive drum 1*a* side). FIG. 9 is a perspective view of the first bearing member 92*a* as seen from the inside (the charging roller 21 side). FIG. 10 is a perspective view of the second bearing member 92*b* as seen from the outside (the side opposite from the charging roller 21). As shown in FIG. 8, in the first supporting frame 51*a*, a drum bearing 85 for rotatably supporting the drum flange 43 of the photosensitive drum 1*a*, a fixed shaft 86 for rotatably supporting an idle gear 82 (see FIG. 7), and a first brush bearing 87 for rotatably supporting the rotary shaft 23*a* of the cleaning brush 23 are integrally formed. At three places on the first supporting frame 51*a*, engaging claws 93 are formed which engage with engaging holes (unillustrated) in the unit case 41.

Although no illustration is given here, on the second supporting frame 51*b* arranged at the other end of the photosensitive drum 1*a*, no fixed shaft 86 or first brush bearing 87 is formed. In the second supporting frame 51*b* are formed the opening 52 (see FIG. 4), the drum bearing 85 for supporting the drum rotary shaft 44 of the photosensitive drum 1*a*, and the engaging claws 93.

As shown in FIGS. 9 and 10, in the first and second bearing members 92*a* and 92*b*, there are integrally formed a roller bearing 88 for rotatably supporting the rotary shaft 21*a* of the charging roller 21, and a second brush bearing 89 for rotatably supporting the rotary shaft 23*a* of the cleaning brush 23. On the bottom surfaces of the first and second bearing members 92*a* and 92*b*, there are formed spring seats 95 with which the coil springs 76 (see FIG. 7) are in contact. The inner diameter of the roller bearing 88 is substantially the same as the outer diameter of the rotary shaft 21*a*. In a state as seen from the side opposite from the charging roller 21 as in FIG. 10, with the roller bearing 88 of the second bearing member 92*b* covered with a cover 93, the bearing hole of the roller bearing 88 is invisible.

In the first bearing member 92*a* arranged on the first supporting frame 51*a* side, the inner diameter of the second brush bearing 89 is made slightly larger than the outer diameter of the rotary shaft 23*a* of the cleaning brush 23, and thus the rotary shaft 23*a* is movable in the radial direction. On the other hand, in the second bearing member 92*b* arranged on the second supporting frame 51*b* side, the inner diameter of the second brush bearing 89 is substantially the same as the outer diameter of the rotary shaft 23*a*.

Figure 11:
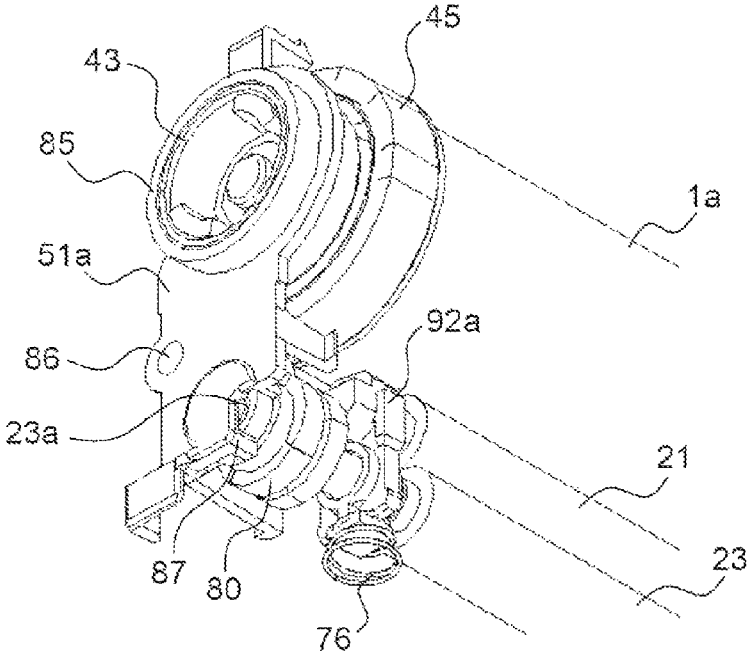
FIG. 11 is a partial perspective view around an end part of the drum unit 40*a* according to the embodiment on the first supporting frame 51*a* side.
Figure 12:
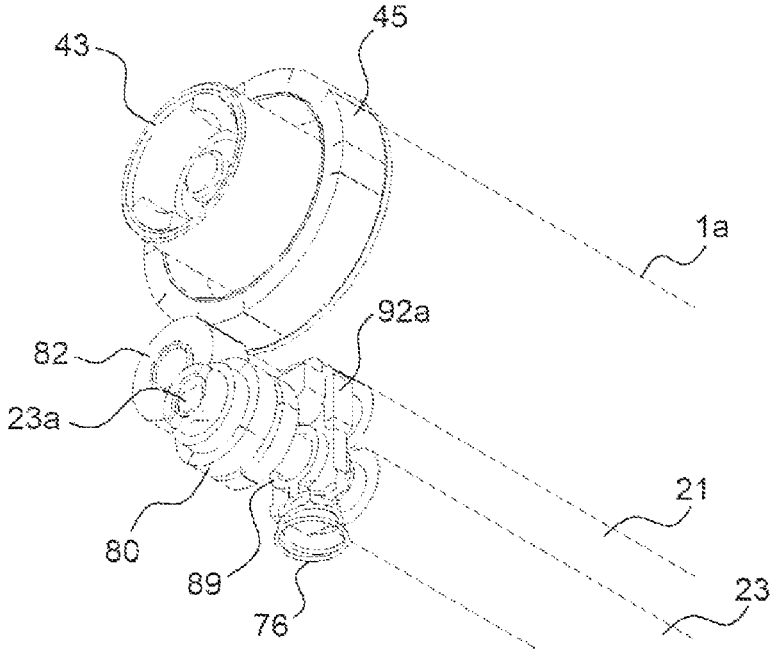
FIG. 12 is a partial perspective view showing a state with the first supporting frame 51*a* removed from the drum unit 40*a* in FIG. 11.
Figure 13:
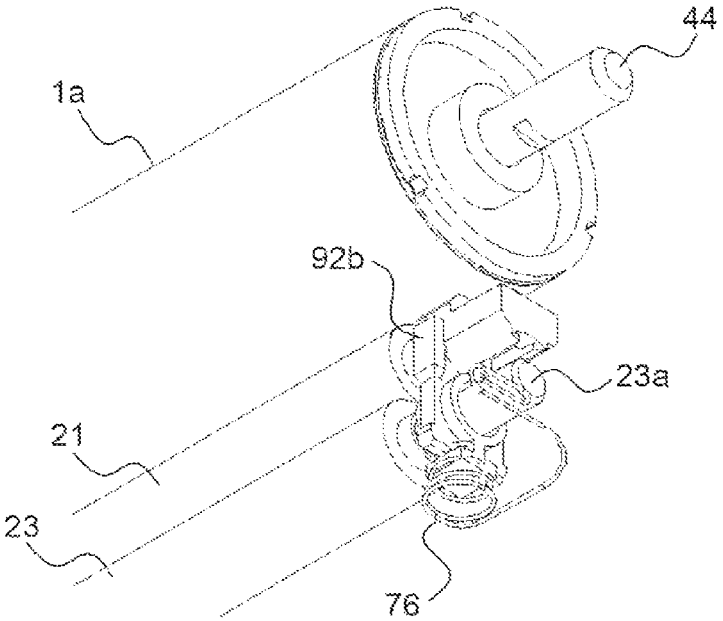
FIG. 13 is a partial perspective view around an end part of the drum unit 40*a* according to the embodiment on the second supporting frame 51*b* side, showing a state with a second supporting frame 51*b* removed.

FIG. 11 is a partial perspective view around an end part of the drum unit 47 on the first supporting frame 51*a* side. FIG. 12 is a partial perspective view showing a state with the first supporting frame 51*a* removed from the state in FIG. 11. FIG. 13 is a partial perspective view showing a state with the second supporting frame 51*b* removed from an end part of the drum unit 47 on the second supporting frame 51*b* side. With reference to FIGS. 5 to 10 as necessary, a driving mechanism of the cleaning brush 23 will be described with reference to FIGS. 11 to 13.

As shown in FIG. 11, the drum flange 43 formed at one end of the photosensitive drum 1*a* is rotatably supported on the drum bearing 85 formed on the first supporting frame 51*a*. One end of the rotary shaft 23*a* of the cleaning brush 23 to which the brush-side gear 80 is fixed is rotatably supported on the first brush bearing 87 formed on the first supporting frame 51*a*.

As shown in FIG. 12, the idle gear 82, which transmits the rotation driving force of a drum-side gear 45 to the first brush bearing 87, is supported on the fixed shaft 86, which is integrally formed with the first supporting frame 51*a*. The first bearing member 92*a*, which rotatably supports the rotary shaft 21*a* of the charging roller 21 and the rotary shaft 23*a* of the cleaning brush 23, is biased in a direction approaching the photosensitive drum 1*a* by the coil spring 76.

As shown in FIG. 13, the drum rotary shaft 44 protruding through the other end of the photosensitive drum 1*a* is rotatably supported on the drum bearing 85 (see FIG. 7), which is formed on the second supporting frame 51*b*. The other end parts of the charging roller 21 and the cleaning brush 23 are rotatably supported on the second bearing member 92*b*, and the second bearing member 92*b* is biased in a direction approaching the photosensitive drum 1*a* by the coil spring 76.

That is, on the first supporting frame 51*a* side, the rotary shaft 23*a* of the cleaning brush 23 is positioned by the first brush bearing 87, which is formed integrally with the first supporting frame 51*a* (dashed circle S1 in FIG. 7). On the other hand, on the second supporting frame 51*b* side, the rotary shaft 23*a* of the cleaning brush 23 is positioned by the second brush bearing 89, which is formed integrally with the second bearing member 92*b* (dashed circle S2 in FIG. 7).

In the charging device 2*a* incorporating a driving mechanism like the one shown in FIG. 12, as the photosensitive drum 1*a* rotates, the charging roller 21 is pressed by the biasing force of the pair of coil springs 76 substantially uniformly in contact with the surface of the photosensitive drum 1*a* via the first and second bearing members 92*a* and 92*b*, and rotates by following the photosensitive drum 1*a*. Moreover, as the photosensitive drum 1*a* rotates, the drum-side gear 45 rotates; this causes the idle gear 82, which meshes with the drum-side gear 45, and the brush-side gear 80 to rotate. The rotation driving force of the drum-side gear 45 is transmitted to the brush-side gear 80, and by this rotation driving force, the cleaning brush 23 is, in a state supported on the first brush bearing 87 of the first supporting frame 51*a* and the second brush bearing 89 of the second bearing member 92*b*, driven to rotate while keeping a linear velocity difference relative to the charging roller 21. In this way, toner, paper dust and the like attached to the charging roller 21 are removed.

In the configuration described above, the drum bearing 85 for supporting one end part of the photosensitive drum 1*a* where the drum-side gear 45 is provided, the first brush bearing 87 for supporting one end part of the cleaning brush 23 (the rotary shaft 23*a*) where the brush-side gear 80 is provided, and the fixed shaft 86 for supporting the idle gear 82 are formed integrally with the first supporting frame 51*a*. This stabilizes the gear pitches of the drum-side gear 45, the idle gear 82, and the brush-side gear 80. As a result, it is possible to effectively suppress occurrence of banding on a charging roller 21 on the driving mechanism side and occurrence of horizontal stripes in an output image resulting from banding on the charging roller 21.

The first and second bearing members 92*a* and 92*b*, which support the rotary shaft 21*a* of the charging roller 21, are biased toward the photosensitive drum 1*a* by the coil springs 76, and thus the charging roller 21 is in contact with the photosensitive drum 1*a* uniformly in the axial direction. Thus, it is also possible to suppress uneven charge distribution on the photosensitive drum 1*a* in the axial direction.

The charging roller 21 and the cleaning brush 23 are supported with a predetermined pitch between them by the first and second bearing members 92*a* and 92*b*; this stabilizes a nip (contact state) between the charging roller 21 and the cleaning brush 23. Thus, by use of the cleaning brush 23, soil attached to the charging roller 21 can be satisfactorily removed.

As described above, the first bearing member 92*a*, which is arranged on the first supporting frame 51*a* side, has a gap formed between the inner surface of the second brush bearing 89 and the outer circumferential surface of the rotary shaft 23*a* of the cleaning brush 23 (dashed circle S3 in FIG. 7). This permits the first bearing member 92*a* to be movable in the radial direction within the gap according to variation in the outer diameter of the charging roller 21, and thus there is no danger of the charging roller 21 floating off the photosensitive drum 1*a* when the outer diameter of the charging roller 21 is small, and no danger of the pressing force of the charging roller 21 toward the photosensitive drum 1*a* increasing when the outer diameter of the charging roller 21 is large.

With the opening 52 (see FIG. 4) formed in the second supporting frame 51*b*, the charging device 2*a* can be drawn out and inserted through the opening 52 in the axial direction relative to the unit case 41. This facilitates maintenance and exchange of the charging device 2*a*.

The embodiments described above are in no way meant to limit the present invention, which thus allows for many modifications and variations within the spirit of the present invention. For example, although the above-described embodiment has dealt with a charging device 2*a* in which the cleaning brush 23 only rotates without reciprocating in the axial direction, even in a case, for example, where the cleaning brush 23 reciprocates in the axial direction while rotating, by positioning the rotary shaft 23*a* of the cleaning brush 23 with the first brush bearing 87 of the first supporting frame 51*a*, it is possible to effectively prevent banding on the charging roller 21.

The present invention is applicable, not only to tandem-type color printers like the one shown in FIG. 1, but to various image forming apparatuses, such as digital and analog monochrome copiers, monochrome printers, color copiers, and facsimile machines, that incorporate a drum unit in which a photosensitive drum and a charging device are integrated into a unit.

The present invention is applicable to an image carrying member unit that incorporates a charging device having a charging roller and a cleaning member. Based on the present invention, it is possible to provide an image carrying member unit that can effectively prevent banding on a charging roller ascribable to the mesh of gears in a driving mechanism and that can satisfactorily maintain contact between the charging roller and the cleaning member and between the charging roller and the image carrying member.

The invention claimed is:

1. An image carrying member unit comprising:

an image carrying member on which an electrostatic latent image is formed, the image carrying member being rotatable;

a charging device including:

a charging roller which electrostatically charges the image carrying member while rotating in contact with a circumferential surface of the image carrying member by following the image carrying member as the image carrying member rotates;

a cleaning member which cleans the charging roller while rotating in contact with a circumferential surface of the charging roller;

a pair of bearing members which rotatably supports opposite end parts of the cleaning member and the charging roller with a predetermined interval between the cleaning member and the charging roller; and a pair of biasing members which biases both the pair of bearing members in a direction approaching the image carrying member; and a pair of supporting frames on each of which an image carrying member bearing is formed, the image carrying member bearing rotatably supporting one end part of the image carrying member, wherein in the one end part of the image carrying member, an output-side gear is provided, in one end part of a rotary shaft of the cleaning member, an input-side gear coupled to the output-side gear is provided, and out of the pair of supporting frames, with a first supporting frame which supports a first end part of the image carrying member where the output-side gear is provided, the image carrying member bearing and a first cleaning member bearing which rotatably supports the one end part of the rotary shaft of the cleaning member where the input-side gear is provided, are integrally formed.

2. The image carrying member unit of claim 1, wherein with the bearing member, a roller bearing which rotatably supports one end part of a rotary shaft of the charging roller and a second cleaning member bearing which rotatably supports the one end part of the rotary shaft of the cleaning member are integrally formed with a predetermined interval between the roller bearing and the second cleaning member, out of the pair of bearing members, in a first bearing member which rotatably supports the one end part of the rotary shaft of the cleaning member where the input-side gear is provided, an inner diameter of the second cleaning member bearing is larger than an outer diameter of the rotary shaft of the cleaning member, and out of the pair of bearing members, in a second bearing member which supports one end part of the rotary shaft of the cleaning member on a side opposite from the input-side gear, the inner diameter of the second cleaning member bearing is substantially equal to the outer diameter of the rotary shaft of the cleaning member.

3. The image carrying member unit of claim 1, wherein out of the pair of supporting frames, in a second supporting frame which supports a second end part of the image carrying member on a side opposite from the output-side gear, an opening is formed for mounting and dismounting the charging device in an axial direction.

4. The image carrying member unit of claim 1, wherein an idle gear is provided which is coupled to the output-side gear and the input-side gear and which transmits a rotation driving force of the output-side gear to the input-side gear, and a fixed shaft which rotatably supports the idle gear is formed integrally with the first supporting frame.

5. An image forming apparatus comprising the image carrying member unit of claim 1.

* * * * *